US005095243A

United States Patent [19]

Kinoshita et al.

[11] Patent Number: 5,095,243

[45] Date of Patent: Mar. 10, 1992

[54] IMAGE TUBE DEVICE

[75] Inventors: Katsuyuki Kinoshita; Tatsuya Matsumura, both of Shizuoka, Japan

[73] Assignee: Hamamatsu Photonics K. K., Shizuoka, Japan

[21] Appl. No.: 598,402

[22] Filed: Oct. 18, 1990

[30] Foreign Application Priority Data

Oct. 20, 1989 [JP] Japan ..... 1-273536

[51] Int. Cl.[5] ..... H01J 31/26

[52] U.S. Cl. ..... 313/376; 313/382; 313/389

[58] Field of Search ..... 313/376, 382, 389, 424; 250/213 VT

[56] References Cited

U.S. PATENT DOCUMENTS 2,760,096 8/1956 Longini ..... 313/376

4,902,927 2/1990 Kinoshita ..... 313/376

*Primary Examiner*—Donald J. Yusko

*Assistant Examiner*—Diab Hamadi

*Attorney, Agent, or Firm*—Finnegan, Henderson, Farabow, Garrett and Dunner

[57] ABSTRACT

Electrons emitted from a photocathode in response to incident X-rays are accelerated and focused onto a microchannel plate (MCP). The electrons multiplied by the MCP are converted into a visible light image by a phosphor screen. An envelope tube is curved at a halfway portion, and the electrons are deflected by a deflection coil so as to travel along the curved envelope tube and enter the MCP. Even if X-rays are transmitted from the photocathode, they do not enter the MCP directly and hardly contribute to the background noise. A limiting aperture ring may further be employed to prevent the X-rays reflected by the inside wall of the envelope tube from entering the MCP.

6 Claims, 3 Drawing Sheets

IMAGE TUBE DEVICE

BACKGROUND OF THE INVENTION

The present invention relates to an image tube device, and more specifically relates to an image tube device which converts incident electromagnetic waves into electrons and outputs an image on the basis of the electrons thus generated.

There have been developed various devices for converting electromagnetic waves such as X-rays transmitted from an object into electrons, and for outputting an observable image of the object on the basis of the electrons thus generated. FIG. 3 shows, as an example of such devices, an X-ray image magnification observing device.

The observing device 10 irradiates an object 12 with X-rays emitted from an X-ray source 11. X-rays transmitted from the object 12 are incident on a window 13 and then imaged by an X-ray magnification imaging means 14. A photocathode 15 is provided at the imaging position of the imaging means 14, and converts the X-rays into electrons. The photocathode 15 is formed on a supporting substrate 15*a* which is thin enough to transmit X-rays. The photoelectrons thus generated are accelerated by means of an acceleration electrode 16 along a direction generally identical to the X-ray incident direction, focused by means of an electromagnetic focusing coil 17, and are finally incident on a microchannel plate (hereinafter abbreviated as MCP) 18 provided on the electron traveling direction. The electrons are multiplied by the MCP 18, and are incident on a phosphor screen 19, where they are converted into a visible light image. By picking up the visible light image by, e.g., TV camera 20, an X-ray magnified image of the object 12 become observable.

In the conventional image observing devices of the above kind, a MCP and a phosphor screen are provided on the direction along which photoelectrons generated by a photocathode are accelerated. Since it is difficult to convert all the incident X-rays into electrons, it is sometimes the case that part of the incident X-rays just pass through the photocathode without being converted into electrons. Particularly as in the above case in which the photocathode is formed on the thin substrate, a larger amount of X-rays are transmitted. Since transmitted X-rays are not influenced by the focusing electromagnetic coil, they travel straight and are incident on the MCP and phosphor screen. As a result, the transmitted X-rays contribute to the output of the phosphor screen as background noise.

It may be conceivable that a shield member is provided on the traveling path of the X-rays. However, since the spread, in the plane perpendicular to its traveling direction, of a photoelectron beam emitted from one point of the photocathode is small, the photoelectron beam itself may strike the shield member, and therefore the incident X-ray corresponding to this particular photoelectron beam will not contribute to an output visible light image. Thus, the provision of such a shield member does not solve the above problem.

SUMMARY OF THE INVENTION

The present invention has been made in consideration of the above problem of the prior art, and therefore, an object of the invention is to provide an image tube device which can eliminate the background noise.

According to the invention, an image tube device having photoelectric coversion means for converting incident electromagnetic waves into electrons, and electron acceleration means for accelerating the electrons emitted from the photoelectric conversion means along a direction generally identical to the electromagnetic wave incident direction, comprises deflection means for deflecting the accelerated photoelectrons so as to introduce those electrons to an area which is out of reach of electromagnetic waves transmitted from the photoelectric conversion means and traveling straight, and image output means for converting the photoelectrons introduced by the deflection means into an output image.

In the above image tube device, the incident electromagnetic waves are converted by the photoelectric conversion means into the photoelectrons, which are then accelerated along the direction generally identical to the electromagnetic wave incident direction. The accelerated photoelectrons are deflected by the deflection means so as to take a traveling direction which is different from the electromagnetic wave incident direction and to be incident on the image output means. Since electromagnetic waves transmitted from the photoelectric conversion means travel straight, only the photoelectrons are incident on the image output means. Therefore, the electromagnetic waves transmitted from the photoelectric conversion means do not influence the output of the image output means, and the background noise originating from the transmitted electromagnetic waves can be reduced.

DETAILED DESCRIPTION OF THE PREFERRED EMBODIMENTS

Figure 1:
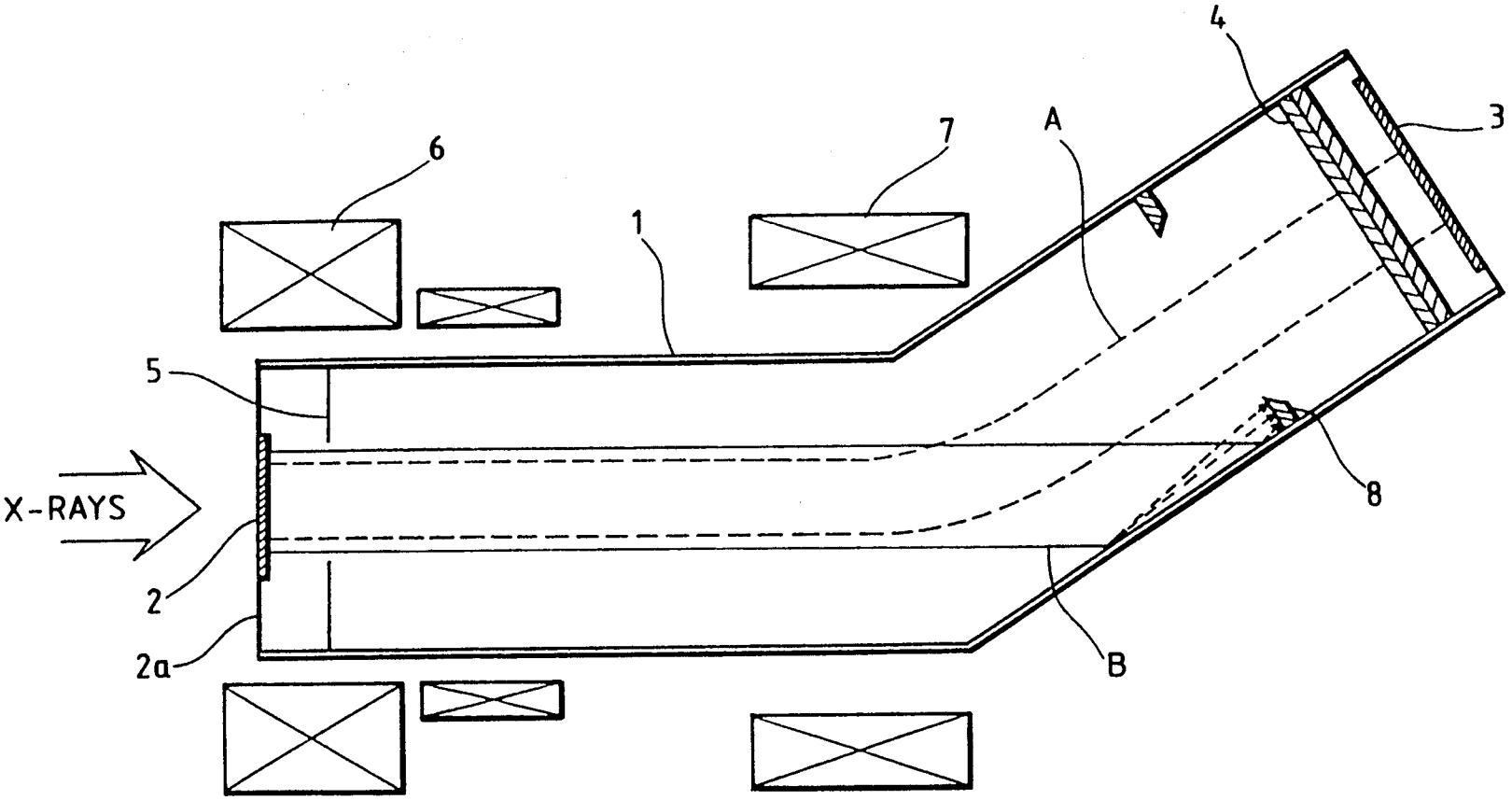
FIG. 1 the general construction of the essential part of an image tube device according to a first embodiment of the present invention.

Preferred embodiments of the present invention will be described with reference to the accompanying drawings. In the drawings, the same reference numerals represent the parts having the same functions, and therefore redundant descriptions for those may be omitted.

FIG. 1 shows the general construction of an image tube device according to an embodiment of the invention. This image tube device is of the type called "zooming tube," which has its sensitivity in the X-ray range and is capable of varying its magnification factor.

As shown in FIG. 1, the image tube device is equipped with a vacuum tube 1 which is curved at the middle portion. At its one end, there is provided a window 2*a* made of beryllium (Be). A photocathode 2 is formed on the inside surface of the window 2*a*. That is, the window 2*a* works as a supporting substrate of the photocathode 2 as well. The beryllium window 2*a* is employed because of its high transmittance of X-rays.

There is arranged inside the tube 1 an acceleration electrode 5 which accelerates photoelectrons emitted from the photocathode 2 along the X-ray incident direction. In the proximity of the other end of the tube 1, there is arranged a MCP 4 for multiplying the photoelectrons incident thereon. Further, a phosphor screen 3 for converting the electrons output from the MCP 4 into visible light is formed on the inside surface of the tube 1. It is required that the MCP 4 and phosphor screen 3 be located out of the path of X-rays transmitted from the photocathode 2. A limiting aperture ring 8 for preventing the X-rays reflected by the inside wall of the tube 1 from entering the MCP 4 is arranged inside the tube 1 in the vicinity of its curving portion.

On the other hand, there is provided outside the tube an electromagnetic focusing coil 6 for focusing the accelerated photoelectrons and imaging a magnified electron image on the MCP 4. Also arranged outside the tube 1 at its curving portion is an electromagnetic deflection coil 7 for deflecting the photoelectons along the curve of the tube 1.

In the following, the background noise reducing operation of the above image tube device will be described with reference to FIG. 1.

Figure 3:
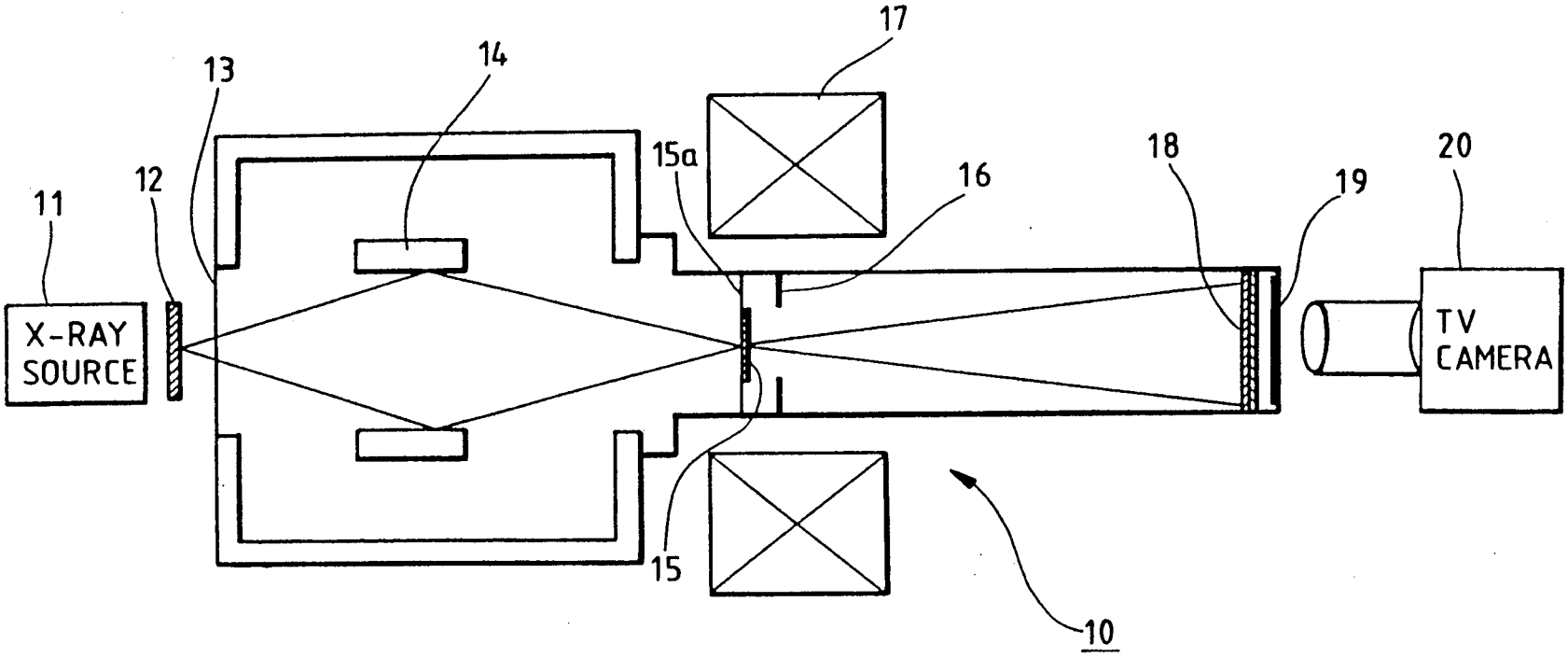
FIG. 3 PRIOR ART
FIG. 3 shows the general construction of a prior art X-ray image magnification observing device.

In the drawing, X-rays incident from the left side pass through the beryllium window 2*a*, and imaged on the photocathode 2. The imaging of the incident X-rays is performed in the same manner as in the prior art device of FIG. 3, and therefore is not described in detail here. The X-rays incident on the photocathode 2 are converted into electrons. That is, photoelectrons corresponding to the intensity of the incident X-rays are emitted to the side opposite to the X-ray incident side. The emitted photoelectrons are accelerated in a direction generally identical to the X-ray incident direction by means of the acceleration electrode 5, and imaged on the input surface of the MCP 4 to form a magnified image by means of the elctromagnetic focusing coil 6 which have an electron lens function. While being imaged on the input surface of the MCP 4, the photoelectrons are deflected by means of the electromagnetic deflection coil 7 along the curve of the tube 1 as indicated in FIG. 1 by dashed lines A. Electrons are then multiplied by the MCP 4, and become incident on the phosphor screen 3, where they are converted into visible light On the other hand, since X-rays non-converted and transmitted from the photocathode 2 are not influenced by the accleration electrode 5, electromagnetic focusing coil 6 and electromagnetic deflection coil 7, they travel straight as indicated in FIG. 1 by solid lines B to strike the inside wall of the curving portion of the tube 1. That is, the transmitted X-rays do not reach the MCP 4 directly, and therefore hardly influence the output of the phosphor screen 3, suppressing the background noise component originating from the transmitted Xrays. In other words, since almost only the photoelectrons are incident on the input surface of the MCP 4, a clear magnified image can be obtained from the phosphor screen 3.

Further, even if the X-rays transmitted from the photocathode 2 strike the inside wall of the curving portion of the tube 1 and reflected toward the input surface of the MCP 4, they are shielded by the limiting aperture ring 8 and do not reach the input surface of the MCP 4. Therefore, it can be said that the existence of the limiting aperture ring 8 further reduces the background noise.

Figure 2:
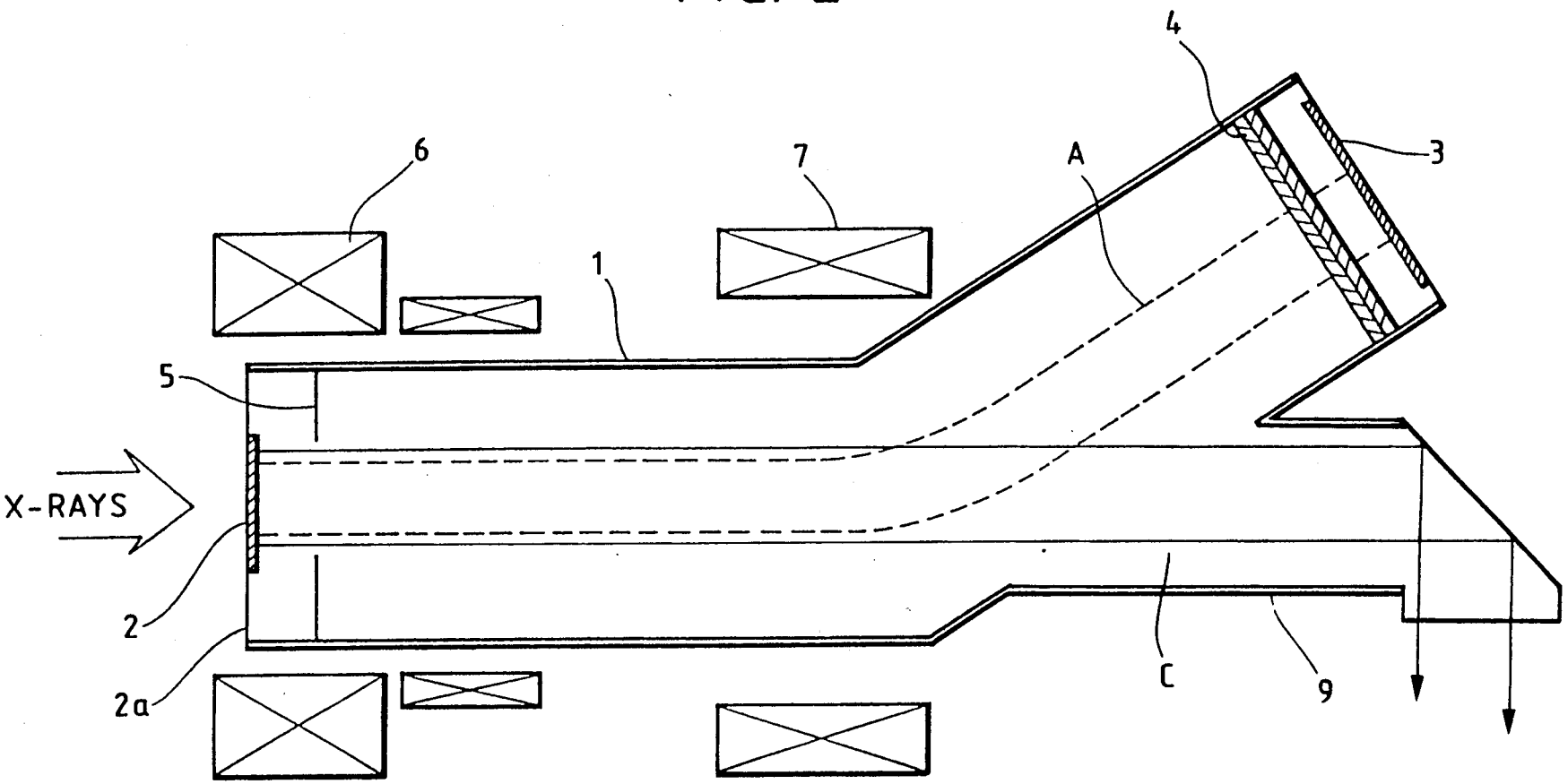
FIG. 2 shows the general contstruction of the essential part of an image tube device according to a second embodiment of the invention.

In order to prevent the X-rays reflected by the inside wall from reaching the MCP 8, there may be various methods other than the employment of the limiting aperture ring 8. An example of such methods is shown in FIG. 2, in which the transmitted X-rays are introduced into a straight tube 9 that is connected to the curving portion of the tube 1. The path of the transmitted X-rays are indicated by solid lines C.

It should be pointed out here that the present invention is not limited to the above embodiments, but, as described below, further modifications can be conceivable.

Although the above enbodiments deal with the image tube device for the X-ray imaging, the present invention is not limited thereto, but may be applicable to image tube devices of the other types, e.g., a streak tube device. Further, images to be observed by an image tube are not limited to an X-ray image, but may be other electromagnetic wave images such as a visible light image, ultraviolet image and soft X-ray image. In order to observe images in the ultraviolet range, the window 2*a* should be a quartz faceplate instead of using a beryllium window. For observation of soft X-ray images, incident optical path should be in vacuum and the window 2*a* should be made of, for instance, silicon nitride or an organic thin film.

Although the above embodiments employ the MCP in front of the phosphor screen to multiply photoelectrons, the MCP may be omitted in the case of receiving intense X-rays.

Although the above embodiments employ the phosphor screen to convert an electron image into an output visible light image, the phosphor screen may be replaced by an electron bombardment type CCD device to produce image data.

Although the above embodiments employ the electromagnetic coil to deflect photoelectons, the photoelectrons may be deflected by electrostatic deflection plates.

Although the above embodiments employ the electromagnetic coil to focus photoelectrond emitted from the photocathode, an electrostatic electron lens may be used instead.

As described above, according to the image tube device of the invention, the background noise originating from the X-rays transmitted from the photocathode can be suppressed, so that only the desired image can be obtained which is carried by photoelectrons.

What is claimed is:

1. An image tube device comprising:

photoelectric conversion means for converting incident electromagnetic waves into electrons;

acceleration means for accelerating the electrons emitted from the photoelectric conversion means along a direction generally identical to an electromagnetic wave incident direction;

deflection means for deflecting the accelerated electrons through a curved path within a curved portion of an envelope of the image tube device to introduce the electrons to an area which is out of reach of electromagnetic waves transmitted from the photoelectric conversion means and traveling straight; and image output means for converting the electrons introduced by the deflection means into an output image.

2. An image tube device according to claim 1, further comprising means for preventing the transmitted electromagnetic waves from entering the image output means.

3. An image tube device according to claim 2, wherein the preventing means comprises a limiting aperture ring for shielding the electromagnetic waves transmitted from the photoelectric conversion means and reflected by an inside wall of said envelope.

4. An image tube device according to claim 2, wherein the preventing means comprises a straight tube connected to said envelope, for introducing the transmitted electromagnetic waves.

5. An image tube device according to claim 1 wherein the envelope of the image tube device is curved in its midsection so as to conform to a traveling path of the electrons.

6. An image tube device according to claim 1, further comprising means for focusing the electrons emitted from the photoelectric conversion means onto the image output means.

* * * * *